United States Patent [19]

Fischer

[11] 4,004,566

[45] Jan. 25, 1977

[54] CLIP AND INDEXING MECHANISM FOR A GAS-OPERATED GUN

[75] Inventor: Earl Lee Fischer, Bentonville, Ark.

[73] Assignee: Minnesota Mining and Manufacturing Company, St. Paul, Minn.

[22] Filed: Apr. 14, 1975

[21] Appl. No.: 567,496

[52] U.S. Cl. ..... 124/59; 124/56; 124/67

[51] Int. Cl.[2] ..... F41B 11/00

[58] Field of Search ..... 124/11, 51

[56] References Cited

UNITED STATES PATENTS

| | | | |
|---|---|---|---|
| 2,713,859 | 7/1955 | Bradfield | 124/11 R X |
| 3,525,319 | 8/1970 | Waldeisen | 124/11 R |
| 3,741,189 | 6/1973 | Kester et al. | 124/11 R |

*Primary Examiner*—Delbert B. Lowe
*Attorney, Agent, or Firm*—Alexander, Sell, Steldt & DeLaHunt

[57] ABSTRACT

A clip and indexing mechanism for a gas-operated gun which affords the visible inspection and incremental advancement and insertion of projectiles from the clip into the chamber of the gun. The clip is formed with a long narrow rectangular web across which are positioned parallel spaced cylindrical cavities, each containing a projectile and each cavity being individually sealed by a mechanically rupturable seal. The gun includes an indexing mechanism for indexing the clip but reciprocation of the breech block to withdraw a bolt or obturator from the clip, index the clip and then force the next projectile through the seal and into the bore also cocks the hammer and further reciprocation before firing the projectile then in the barrel does not operate the indexing mechanism. Releasing the hammer resets the indexing mechanism to index the clip. The breech block is reciprocated after firing, and this motion cocks the hammer and operates a lever to reciprocate a pawl and index the clip through an opening in the housing extending transversely of the barrel. The clip is formed of a translucent polymeric material permitting the visible inspection of the color of the projectiles therein. The gun has a high pressure gas valve with two chambers and two outlet valves leading to different barrels for firing different projectiles.

10 Claims, 9 Drawing Figures

CLIP AND INDEXING MECHANISM FOR A GAS-OPERATED GUN

BACKGROUND OF THE INVENTION

1. Field of the Invention

This invention relates to an improvement in an indexing mechanism for registering and advancing a clip structure and to an improvement in a gun for projecting hygienic ballistic implant projectiles and for shooting marking projectiles for animal care and management functions.

2. Description of the Prior Art

The prior art discloses various clip and gun structures facilitating the successive firing of projectiles. One patent in particular relating to a gas-operated pellet gun utilizing a clip for feeding pellets to the gun is U.S. Pat. No. 3,741,189, issued June 26, 1973, to Kester and Hughes. The gas-operated gun of this patent utilizes a clip which holds a plurality of pellets. The clip is designed to be placed in the gun and when the clip is in position in the gun the pellets are indexed automatically into firing position each time the manually operated bolt is retracted. The gun has a reciprocable hammer and a rotatable indexing means for indexing the clip. A manually reciprocable cocking mechanism will operate the indexing mechanism to index the clip when cocking the hammer. The gun of the Kester and Hughes invention utilizes an obturator which penetrates the clip to drive the pellet therefrom and into the bore of the gun. When the bolt is again retracted, however, even before firing, the clip is indexed. A gas valve allows a supply of compressed gas to escape upon release of the hammer to fire the pellet from the gun.

Other patents relating to gas-operated guns for the firing of projectiles include U.S. Pat. No. 3,788,298, issued Jan. 29, 1974 to Hale. This patent discloses a pistol for firing hollow plastic or gelatin balls filled with a liquid such as paint for marking animals, trees, or other objects. In this patent a supply of balls is supported to be moved by gravity into the firing chamber.

Other patents relating to clips for pellets designed for implant in an animal include U.S. Pat. No. 3,520,299, issued July 14, 1970 to Lott et al; U.S. Pat. No. 3,669,104, issued June 13, 1972 to Wyatt et al.; and U.S. Pat. No. 3,774,607, issued Nov. 27, 1973 to Schmitz. The implant devices of these structures utilize a needle through which the pellet is driven after the needle is inserted beneath the skin of the animal. In each of these devices a plunger, operated by a trigger, is utilized to drive the pellet from the needle. The pellets however are supplied to the implant gun by a suitable clip or magazine-type cartridge. The clip in each of these patents is circular and U.S. Pat. No. 3,774,607 discloses a structure wherein the line of travel of the plunger 20 can be observed by the operator to determine whether a cylinder of the cartridge is directly aligned with the plunger and whether that cylinder contains pellets. The magazine-type cartridges described in U.S. Pat. No. 3,520,299 are adapted to be advanced mechanically upon movement of the plunger such that successive magazine apertures are aligned with openings in the case. A detent is provided on the case for preventing movement of the magazine relative to the case in the direction opposite to its advancing direction. This structure is similar to the indexing mechanism of Kester et al., U.S. Pat. No. 3,741,189.

The clip and indexing structure of the present invention permit the same to be readily inserted and removed from the gun without damaging the aseptic seals on the chambers housing the projectiles. The clip is indexed into position upon reciprocation of the breechblock and a projectile is placed in the firing chamber after the hammer is cocked. Subsequent operation of the breechblock before the hammer is released will not permit indexing of the clip. This restricts the loading of more than one projectile in the firing chamber.

The clip is structured to permit its easy insertion and removal and is formed to be inserted and removed by movement of the clip in only one direction in relationship to the housing of the gun, The gun has two barrels from which to fire projectiles, One barrel for the nonlethal ballistic implantation of a projectile from the clip totally within a living animal body to release a biologically active material in the animal body and a second barrel to fire a marking projectile against the animal body which will rupture upon impact.

The gun has a compressed gas valve with two chambers and two hammer-operated release valves for releasing gas from each chamber into an associated barrel. One chamber is connected to the barrel for implanting a projectile and when it is exhausted the second chamber is still charged to fire a projectile from the marking barrel.

SUMMARY OF THE INVENTION

This invention provides an improved gun for use in animal care, control and/or management and includes an improved clip indexing system to make its use safe, reliable and efficient.

The gun is a gas-operated instrument having a housing, a barrel for receiving a ballistic projectile, a breechblock reciprocally mounted in the housing for inserting projectiles into the barrel and for sealing the bore, an indexing means for advancing a clip stepwise through the housing to place the projectiles in the clip in alignment with the barrel, and means for disabling the indexing means upon cocking a hammer to restrict the insertion of more than one projectile into the bore.

The gun desirably has an additional bore for firing a marking projectile and a gas valve to permit the marking projectile to be fired after firing the ballistic projectile.

A clip is structured to supply the ballistic implant projectiles and is structured to be inserted in only one orientation and moved through the housing in only one direction. The clip receiving opening permits the visual inspection of the clip which is preferably formed of a translucent polymeric material.

DESCRIPTION OF THE DRAWING

The foregoing and other features of the present invention will be more fully understood after reading the following description which refers to the accompanying drawing wherein.

DESCRIPTION OF THE PREFERRED EMBODIMENT

Figure 1:
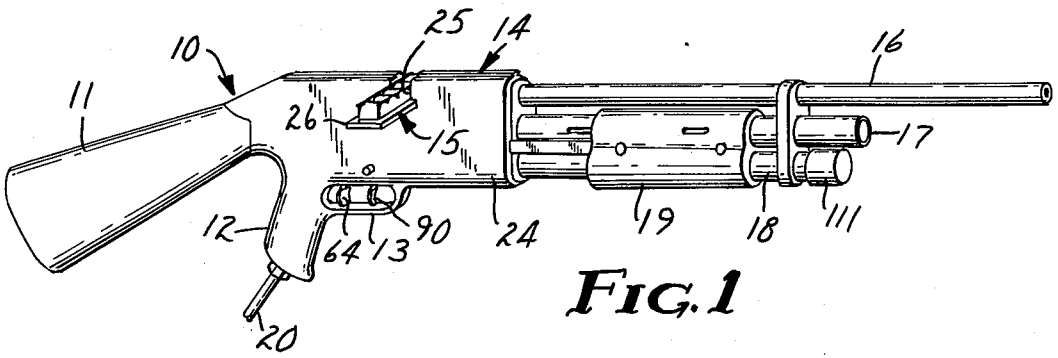
FIG. 1 is a perspective view of a gun for firing ballistic implant projectiles and marking projectiles.

The gun of this invention is generally designated 10 and comprises a compressed gas, preferably air, operated instrument for firing small calibre projectiles which are adapted for nonlethal implantation of a ballistic projectile containing a biologically active material into the body of an animal, and for firing a marking projectile which will shatter on impact for marking the animal, such as a paint ball or other projectile. As illustrated, the gun 10 comprises a stock 11, a hand grip 12, trigger guard 13, a housing, generally designated 14, to receive a clip 15, a first barrel 16 for firing the small projectile, a barrel 17 for firing the marking projectile, a chamber 18 for receiving a supply of the marking projectiles, and the slide 19 for operating the mechanism within the housing 14. A supply line is connected to the hand grip 12 and, as illustrated, includes a conduit 20 which leads from a supply of compressed gas to the housing, as will be described in greater detail hereinafter.

Figure 2:
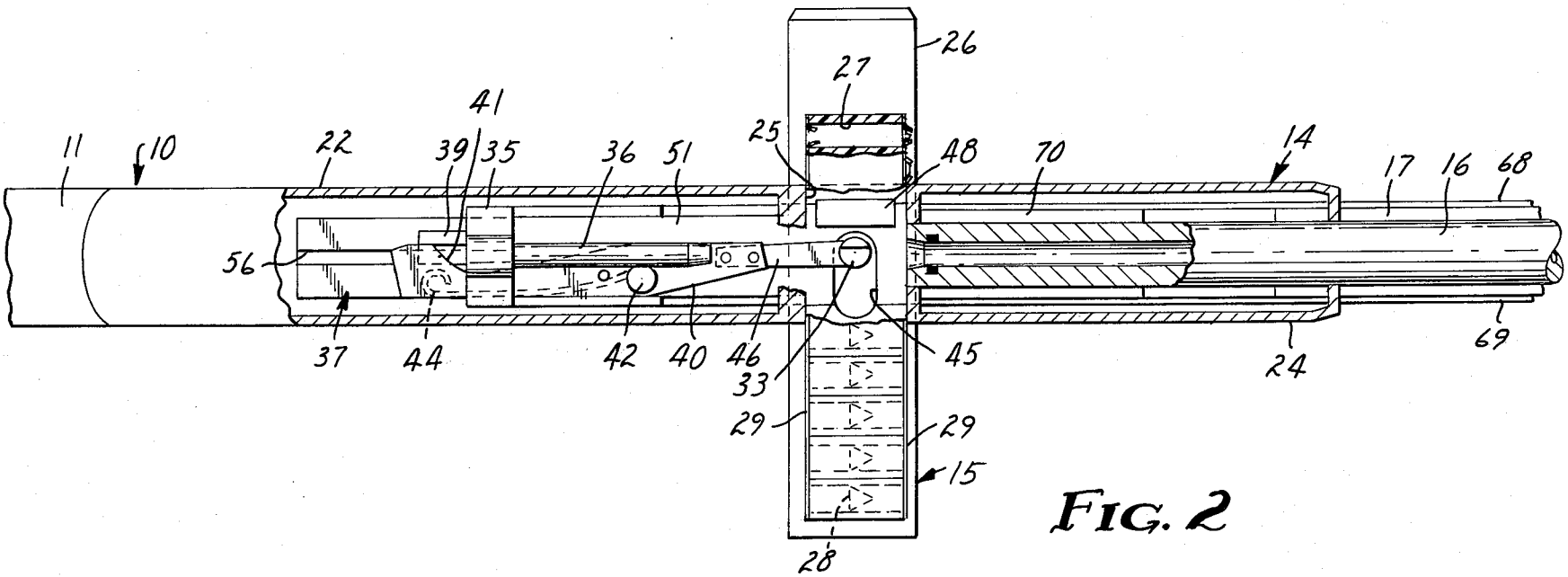
FIG. 2 is a fragmentary plan view of the gun of FIG. 1, partially in section, illustrating the clip indexing mechanism in the indexed position.
Figure 3:
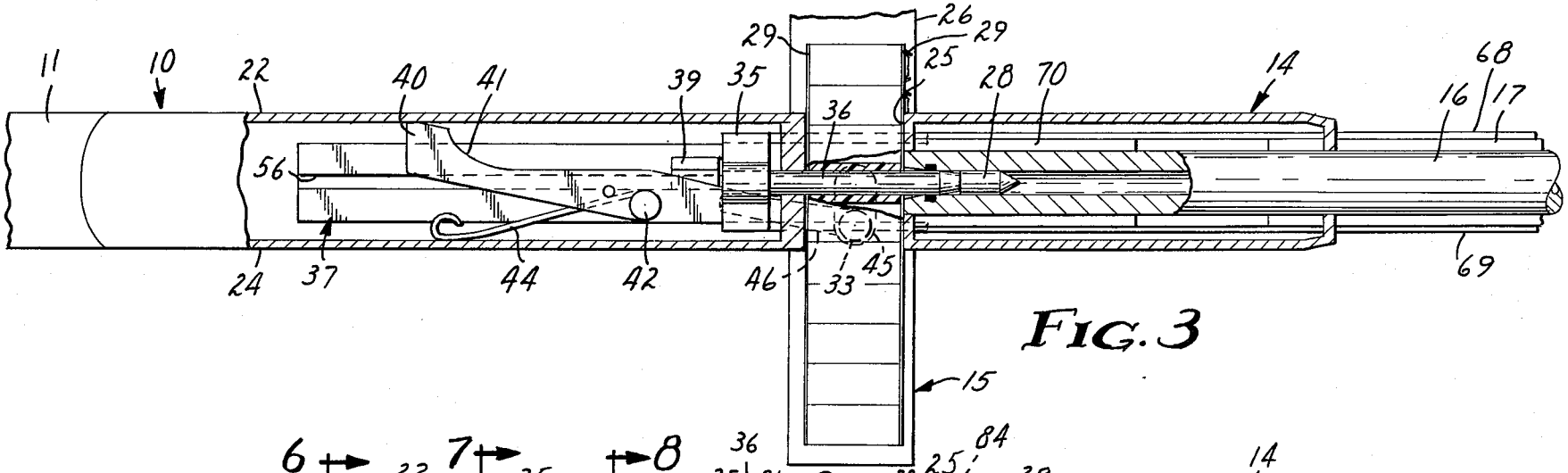
FIG. 3 is a fragmentary plan view of the gun of FIG. 1 similar to FIG. 2 illustrating the clip indexing mechanism in the index position upon firing a projectile.

Referring now to FIGS. 2 and 3, there is illustrated in section the clip receiving and indexing mechanism for the housing together with the obturator which is advanced and retracted through the chambers of the clip 15 to move the projectiles from their hygienic atmosphere into the bore of the barrel 16 and to seal the bore. The housing 14 is formed of mating side sections 22 and 24 and they have a transverse opening 25 therethrough which receives the clip 15. This transverse opening is at the end of the barrel 16, having a ten-sided bore or lands and grooves to aid in firing the ballistic projectile.

Figure 9:
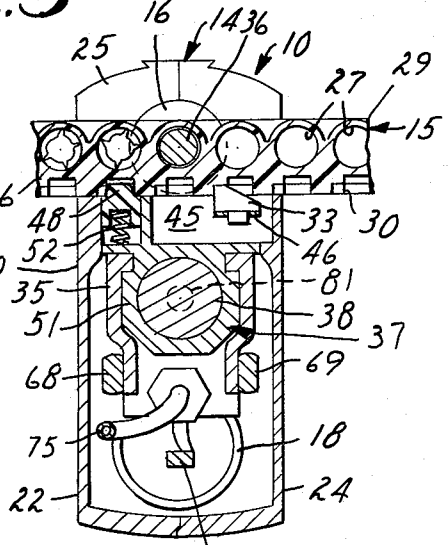
FIG. 9 is a transverse sectional view taken along the lines 9—9 of FIG. 4.
Figure 8:
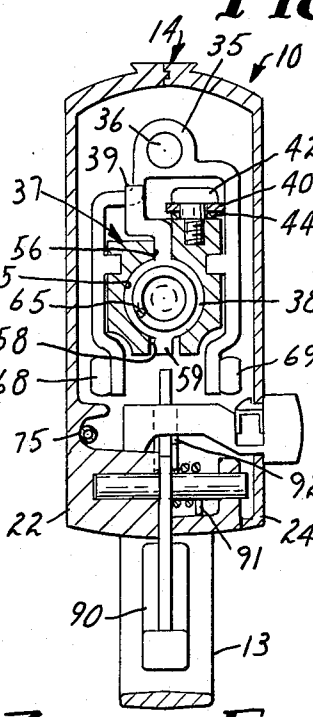
FIG. 8 is a transverse sectional view taken along the lines 8—8 of FIG. 4.
Figure 7:
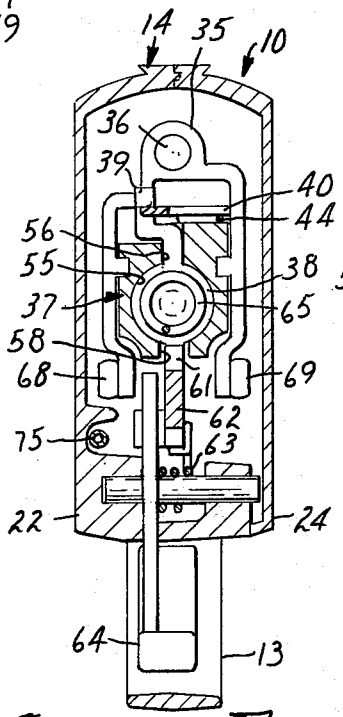
FIG. 7 is a transverse sectional view taken along the lines 7—7 of FIG. 4.
Figure 6:
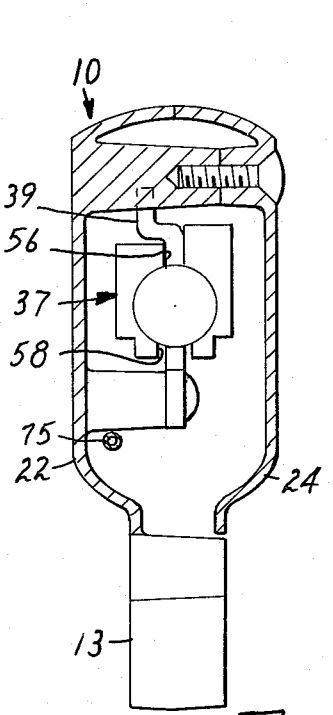
FIG. 6 is a transverse sectional view taken along the lines 6—6 of FIG. 4.

The clip 15 comprises a molded structure including a rectangular web 26 on the upper surface of which is a plurality of aseptically sealed cylindrical chambers 27 having parallel axes and each containing a ballistic implant projectile 28. The chambers 27 are sealed at each end by a mechanically rupturable sealing means such as a film 29 heat sealed about each end of each chamber. On the surface of the web 26 opposite the chambers is a plurality of transversely extending rectangular recesses 30 (see FIG. 9) associated with each of the cylindrical chambers 27 to align the cylindrical chambers successively with the bore of the barrel 16. The opening 25 has lower recess areas 31 which accommodate the edges of the web 26 of the clip 15 and the recesses are of different widths to accept a particular edge of the clip and assure that the clip is properly aligned and inserted correctly to properly position the projectiles. The cylindrical portions are not symmetrically placed on the web 26 to define the different width edges and to form a tonque. The shape of the clip thus prevents misalignment.

The clip is initially slid into the opening 25 until a first recess 30 passes over an advancing pawl 33 which will produce an audible click as the same is resiliently urged out of its normal position and into the first recess 30. The slide 19 can then be operated to retract a breechblock 35 which supports a bolt or obturator 36 for the bore of the barrel 16. The breechblock retracts a hammer 38 mounted for reciprocation in a bore in a guide frame 37. The hammer 38 has a projection 39 movable longitudinally of the housing to engage a lever 40 having a cam surface 41 which causes the lever 40 to pivot about a pin 42 against the bias of a spring 44 and move the pawl 33 in a slot 45. The arm 40 is formed from flat stock material and has a resilient forward portion 46, which could be spring material, having sufficient resilience to permit the pawl 33 to be biased downwardly during the insertion of a clip and during movement of the pawl from the position of FIG. 2 to the position of FIG. 3 to move from one recess 30 to another when the projection 39 is moved from a position disabling movement of the lever 40 to the fired position with the hammer. In FIG. 2 the breechblock 35, which is generally an inverted U-shape and surrounds the frame 37, has the hammer projection 39 moved along the lever 40 to bias the arm 40 to its clip advance position. At this position the obturator 36 has been retracted from the bore, and upon return of the slide 19 the obturator 36 will rupture a film 29 forcing the projectile 28 to rupture the opposite film 29 and will force the projectile into the bore of the barrel 16 and again seal the bore. The hammer and projection 39 will be retained in its cocked position by a trigger sear and the weapon will be ready for firing.

The projection 39, with the hammer 38 cocked, is positioned to contact the end of the lever 40 remote from the pawl 33 and urge it against spring 44, thus disabling the indexing pawl until the hammer is released. Subsequent reciprocation of the breechblock 35 cannot pivot the lever 40 against the spring 44 to index the clip 15 through the housing until after the hammer is released.

The housing comprises a further spring-biased catch 48 which is positioned between a wall 50 of the housing section 22 and the fixed frame 37 in the opening 25. A spring 52 urges the catch 48 into engagement with a recess 30. The catch 48 aligns the clip to position a chamber in alignment with the obturator and bore.

Figure 4:
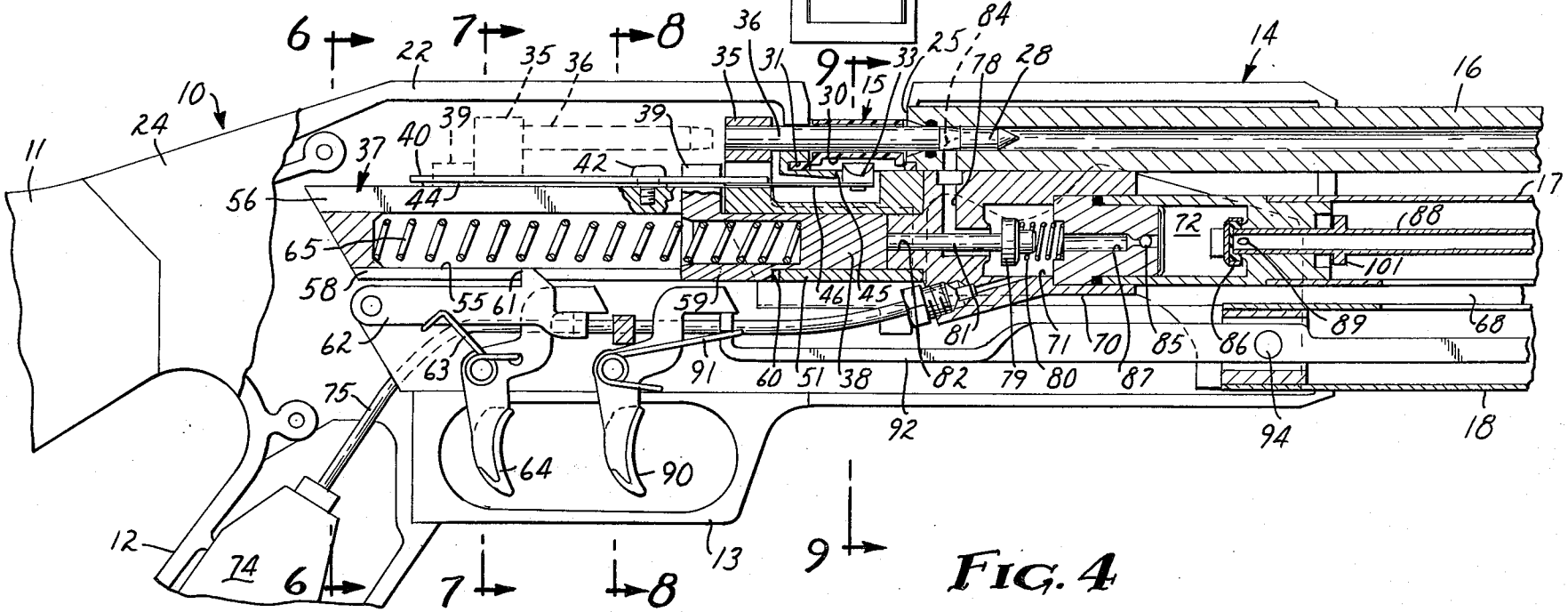
FIG. 4 is a fragmentary longitudinal sectional view of the gun and clip incorporating the features of the present invention with the gun in a fired or firing position.

Referring now to FIG. 4 there is illustrated a vertical sectional view of the housing 14 with the members in firing or fired position and this figure illustrates in broken lines the movement of the breechblock 35 from the index and cock position to the set and firing position. The hammer projection 39 is also moved from the dotted disabling position holding the lever 40 against the bias of spring 44 to the firing or rest position. The guide frame 37 has a longitudinal cylindrical bore 55 in which is movably mounted the hammer 38 and the frame has an upper slot 56 through which the projection 39 projects and a lower slot 58 through which a depending flange 59 of the hammer projects. The flange 59 has a shoulder 60 to lock behind a sear 61 on a pivoted arm 62 cooperating with the trigger 64 which trigger controls the firing of the upper barrel 16 and discharge of the implant projectile. The hammer 38 in its cocked position is held by the sear 61 against the force of a return spring 65 which spring drives the hammer forward upon operation or pulling of the trigger 64. A torsion spring 63 maintains the arm 62 and trigger 64 in the ready position to receive the hammer 38 and catch the shoulder 60 as the same is retracted by the slide 19 and breechblock 35.

The breechblock 35 extends around the slide 51 and is generally U-shaped with the U inverted and the two legs of the U extending along the sides of the guide frame 37. The legs are coupled to bars 68 and 69 which extend from the slide 19.

A valve assembly 70 is positioned in the housing 14 forwardly of the frame 37 and is supported thereby. The valve assembly 70 is provided with two air chambers 71 and 72 for receiving air under compression from a suitable source which may be a cartridge or cylinder of compressed gas through the conduit 20 and into a coupling 74, through a hose 75 connected to an inlet valve on the valve assembly 70. The first chamber 71 is sealed from a passageway 78 by a valve 79 normally closed under the bias of a spring 80. A rod 81 extends from the valve 79 longitudinally of the gun through a bore 82 to be positioned in the bore 55 of the frame 37 affording engagement thereof by the hammer 38 to instantaneously open the valve 79 allowing gas from the chamber 71 to flow through passage 78 and through a recess 84 in the obturator 36 to position the gas behind the projectile 28. Normally the spring 80 will hold the valve 79 closed against its seat to permit recharging of the gas within the chamber 71. A ball check valve 85 positioned in a passageway 87 between the chamber 71 and the second chamber 72 permits the gas in the chamber 71 to charge that second chamber. The chamber 72 is normally sealed at the discharge end by a valve 86 biased against a seat. The valve 86 closes the end of a hollow tubular rigid conduit 88 having an opening 89 in the side wall thereof adjacent the valve 86. Air in the chamber 72 is utilized to fire the marking projectile through the barrel 17 upon operation of a second trigger 90 within the trigger guard 13.

Figure 5:
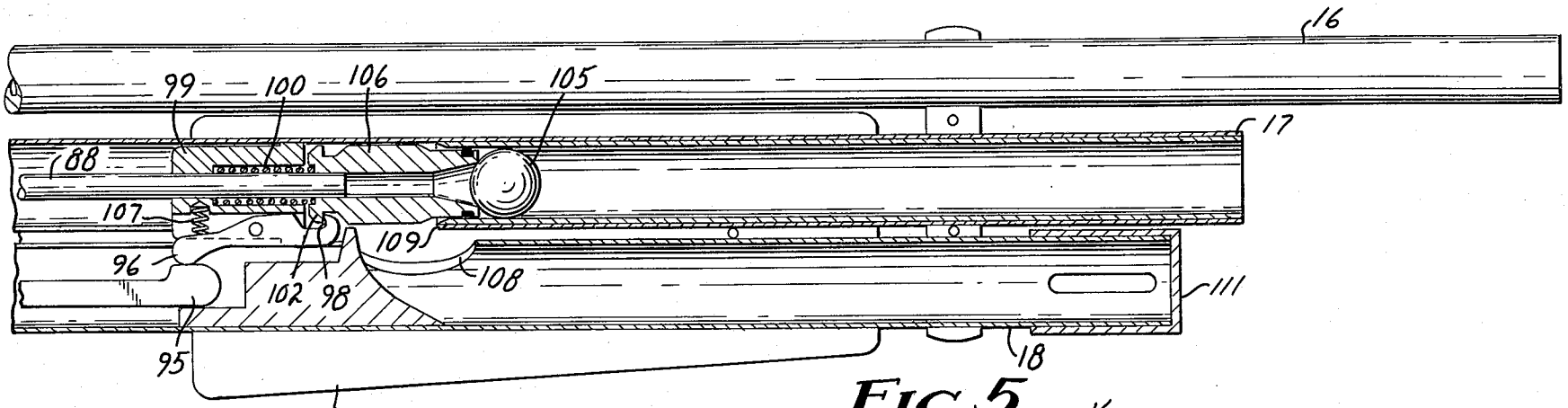
FIG. 5 is a fragmentary longitudinal sectional view of the forward portion of the gun showing the magazine and the firing chamber for the marking projectile.

Referring now to FIGS. 4 and 5, which show the longitudinal sections of the gun 10, it will be noted that the trigger 90 is retained by a torsion spring 91 which also biases a pivoted arm 92 in a downward position about its pivot pin 94 to force the opposite end 95 thereof into engagement with a pivoted link 96 carrying the sear 98 (see FIG. 5). The sear 98 is fixed to and holds the hammer 99 for the barrel 17 in the cocked position. When the hammer 99 is in a cocked position a spring 100 is compressed tightly about the tube 88 between the hammer 99 and an obturator 106. Upon operation of the trigger 90 the lever 92 is pivoted to cause a pivoting of the link 96 and a release of the sear 98 from a shoulder 102 about one end of the obturator 106. The spring 100 then drives the hammer 99 against a flange 101 on the tube 88 forcing the valve 86 to open momentarily, allowing gas in the chamber 72 to escape through the opening 89 and through the bore in the tube 88 to a position behind the marking projectile 105 to project the same from the barrel 17. The obturator 106 for the barrel 17 is connected to the slide 19 and as it is driven by the slide 19 toward the hammer 99 which is now positioned near the valve assembly 70, a marking projectile is allowed to roll from the chamber 18 through an opening 108 and an opening 109 into the barrel 17 ahead of the obturator 106. As the slide and obturator 106 pick up the hammer 99 by the sear 98 the spring 100 is again compressed and the obturator 106 is moved back into position, positioning the marking projectile 105 in the chamber 17. The obturator 106 has a longitudinal bore therethrough allowing the gas from the tube 88 to strike the end of the marking projectile 105. A cap 111 is removable to permit marking projectiles to be loaded in the chamber 18 and the chamber permits them to be freely moved therein.

The check valve 85 permits the firing or discharge of the gas from the chamber 72 after the firing of the gas from the chamber 71. This check valve maintains the chamber 72 under pressure until the valve 86 is opened by the hammer 99.

A spring 107 supported by the hammer 99 biases the link 96 toward a cocked position such that the sear 98 is normally in a position to be biased around and catch the shoulder 102 of the obturator 106. This gun also has a safe lock (not shown) for releasably locking the triggers when the hammers are cocked.

The obturator 36 has a diameter smaller than the diameter of the chambers 27 in the clip and the end of the barrel 16 has an area to receive the ruptured film portions to avoid interference with the other functions of the mechanism.

The ballistic projectile is preferably a 25 calibre projectile about 0.5 inch (1.25 cm) long, 0.25 inch (0.6 cm) in diameter and weighing 0.75 to 0.83 grams. The projectiles described can be propelled at the large neck muscle in the upper portion of the neck of the cattle from a distance of about 20 feet (6 meters). The projectiles exit the muzzle of the gun 10 with a muzzle velocity of about 900 feet per second (275 meters/sec) and will penetrate the hide on the necks of the cattle and lodge in the muscle at a depth of about 1 to 2 inches (2.5 – 5 cm) beneath the skin. The gun is provided with gas at 1150 ± 50 pounds per square inch (psi) (84 ± 3.65 kg/cm$^2$) and will fire the projectile 50 feet (15 meters) with sufficient force to effect an implant.

An application filed concurrently with this application in the name of Earl Lee Fischer and Jay W. Gould III for A Clip for Supplying Implant Projectiles, Ser. No. 567,495, filed Apr. 14, 1975, attorney docket No. 29, 436, is directed to the clip described in this application and is assigned to the assignee of this application.

Having described this invention what is claimed is:

1. A gun comprising:

a housing, a barrel on said housing for receiving a projectile;

a breechblock for sealing one end of the barrel, said breechblock being reciprocally mounted in said housing and having obturator means for placing the projectile in the barrel;

hammer means movable within said housing for firing a said projectile, said hammer means being moved to the cocked position upon reciprocation of the breechblock;

indexing means for advancing a clip in said housing to position successive chambers with projectiles therein in alignment with said barrel and the path of said obturator means, and disabling means to prevent operation of said indexing means to advance said clip upon subsequent reciprocation of said breechblock when said hammer means is in said cocked position, whereby said clip cannot be advanced by said indexing means and additional projectiles placed in the barrel until the first projectile is fired.

2. A gun according to claim 1 wherein said indexing means comprises a lever extending longitudinally within said housing, a cam surface on one end of said lever and a pawl on the opposite end, pivot means pivoting said lever intermediate its ends, spring means for biasing said pawl toward one side of said housing, and said disabling means comprises a projection moved longitudinally by said breechblock along said lever to engage said cam surface and shift said pawl transversely against the bias of said spring means and sear means for releasably retaining said projection in engagement with said cam surface to prevent movement of said pawl.

3. A gun according to claim 2 wherein said projection is fixed to said hammer means and locks said lever when said hammer means is in cocked position.

4. A gun according to claim 1 wherein said housing includes a gas chamber for storing compressed gas and release valve means communicating with said barrel and said gas chamber and opened by said hammer means for firing a projectile from said barrel.

5. A gun according to claim 1 comprising a second barrel parallel to said first-mentioned barrel, an obturator for said second barrel, said hammer means for firing said second barrel, slide means connected to said breechblock and said obturator for cocking said hammer means, air chamber means for storing compressed gas and valve means actuated by said hammer means for firing said barrels upon the release of said hammer means, and trigger means for releasing said hammer means independently.

6. A gun according to claim 5 wherein said valve means comprises two release valve means for firing said barrels, whereby said first-mentioned hammer means may be released and gas released from said chamber means by one release valve means and then the second hammer means may be released and gas released from said chamber means by the second hammer means operating the second release valve means.

7. A gun according to claim 1 wherein said housing has a transverse opening at the rear of said barrel and said indexing means includes a pawl oscillating along an edge of said opening to advance a clip therethrough, said pawl being supported on a resilient member and biased toward said opening to engage openings in a said clip to advance the clip linearly.

8. A gun assembly for firing hygienic ballistic implant projectiles from a clip containing individually aseptically sealed projectiles comprising:

a housing, a barrel having a bore mounted on said housing, a breechblock movable longitudinally within said housing including an obturator movable in axial alignment with the bore of said barrel, means supported by said housing for reciprocating said breechblock, a hammer slidably mounted in said housing, spring means for driving said hammer from a cocked position to a firing position, means interconnecting said breechblock and said hammer for cocking said hammer upon reciprocation of said breechblock, and said housing having an opening extending transversely thereof and in the path of movement of said obturator and positioned between said barrel and said breechblock for receiving a clip, a pawl positioned adjacent said opening and mounted for movement transverse to the direction of movement of said obturator to advance a clip through said transverse opening, spring means moving said pawl in a first transverse direction, and means cooperating with said hammer upon reciprocation thereof to cock said hammer for moving said pawl to advance a said clip and for holding said pawl against the bias of said spring means to restrict movement of said pawl in said first direction.

9. A gas-operated gun for firing a projectile supplied to said gun in a clip having a plurality of parallel chambers sealed by mechanically rupturable seals and each chamber holding a said projectile, and said chambers being positioned on a web, and said web having a plurality of recesses opposite said chambers, said gun comprising:

a housing, a gas valve positioned within said housing, a barrel having a small bore fastened at one end in said housing and having an opening communicating with a normally closed discharge passage from said valve, a breechblock including a bolt aligned with the bore of said barrel and supported for reciprocation within said housing with said bolt aligned with said bore, means for reciprocating said breechblock, a hammer, means within said housing slidably supporting said hammer for reciprocation, spring means normally urging said hammer toward said valve, means interconnecting said hammer and said breechblock for movement of said hammer to cocked position upon movement of said breechblock to move said bolt from said bore, guide means for receiving and supporting said clip at said one end of said barrel, detent means adjacent said guide means for engagement with said recesses in said clip, oscillating pawl means disposed adjacent said guide means for advancing a clip through said housing transverse to said bore, means for advancing said pawl in a first direction in response to movement of said breechblock in a direction to cock said hammer for advancing said clip and for holding said pawl in said advanced position when said hammer is cocked, whereby said pawl means will advance a said clip through said housing to align a cylindrical portion thereof with said bore upon retraction of said bolt from said bore and said pawl means will be held in place with the hammer cocked, and trigger means for releasing said hammer upon return of said breechblock and said bolt to close the barrel for allowing said hammer to operate said valve to fire a projectile and release said pawl means.

10. A gun according to claim 9 comprising a second barrel positioned parallel to said first-mentioned barrel, an obturator for said second barrel, a second gas valve positioned between a supply of gas under pressure and said second barrel, a second hammer slidably mounted and urged in one direction toward said second gas valve for firing said second barrel, reciprocating means for moving said breechblock and said obturator for cocking said hammers, chamber means forr storing a supply of projectiles for said second barrel, and second trigger means for releasing said second hammer.

* * * * *